US009377721B2

(12) United States Patent
Michishita

(10) Patent No.: US 9,377,721 B2
(45) Date of Patent: Jun. 28, 2016

(54) IMAGE FORMING APPARATUS

(71) Applicant: KYOCERA Document Solutions Inc., Osaka (JP)

(72) Inventor: Yasuhiro Michishita, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/300,652

(22) Filed: Jun. 10, 2014

(65) Prior Publication Data

US 2014/0363181 A1 Dec. 11, 2014

(30) Foreign Application Priority Data

Jun. 11, 2013 (JP) ..... 2013-123244

(51) Int. Cl.
*G03G 15/00* (2006.01)
*G03G 15/16* (2006.01)

(52) U.S. Cl.
CPC ..... *G03G 15/1665* (2013.01); *G03G 15/6535* (2013.01)

(58) Field of Classification Search
CPC . G03G 21/20; G03G 15/1675; G03G 15/161; G03G 15/0189; G03G 15/55
USPC ..... 399/44
See application file for complete search history.

(56) References Cited

U.S. PATENT DOCUMENTS 6,987,658 B2 * 1/2006 Lu ..... H05F 3/04 361/212
2003/0072579 A1 * 4/2003 Bessho ..... G03G 15/0131 399/44
2009/0009922 A1 * 1/2009 Hirai et al. ..... 361/213
2011/0085810 A1 * 4/2011 Choi ..... G03G 15/1675 399/45
2012/0014705 A1 * 1/2012 Nishida ..... G03G 15/657 399/66

(Continued)

FOREIGN PATENT DOCUMENTS

JP 06-110338 4/1994
JP 08-095397 A 4/1996

(Continued)

OTHER PUBLICATIONS

Machine translation of Tagami, JP 2002-031960 A, publication date: Jan. 31, 2002.*

(Continued)

*Primary Examiner* — Walter L Lindsay, Jr.
*Assistant Examiner* — Frederick Wenderoth
(74) *Attorney, Agent, or Firm* — Knobbe, Martens, Olson & Bear LLP

(57) ABSTRACT

An image forming apparatus includes: an image carrier; a transfer belt facing a surface of the image carrier, forming a nip serving as a transfer position with the image carrier, and configured to transfer a toner image formed on the surface of the image carrier to a recording paper sheet with a transfer bias of opposite polarity to the surface of the image carrier; a fixing section configured to heat the sheet having the transferred toner image thereon to fix the toner image; and a static eliminator disposed downstream of the transfer position in a direction of conveyance of the sheet and configured to expose a back surface of the sheet opposite to the surface having the transferred toner image thereon to a DC discharge having the same polarity as the transfer bias and directed toward a position where the sheet separates from the transfer belt.

4 Claims, 5 Drawing Sheets

(56) References Cited

U.S. PATENT DOCUMENTS

| | | | | |
|---|---|---|---|---|
| 2012/0230746 | A1* | 9/2012 | Namisaki | G03G 15/2085 399/400 |
| 2013/0078014 | A1* | 3/2013 | Ogiyama | 399/315 |

FOREIGN PATENT DOCUMENTS

| | | | |
|---|---|---|---|
| JP | 2002-031960 | A | 1/2002 |
| JP | 2002-082496 | | 3/2002 |
| JP | 2010-256574 | | 4/2009 |

OTHER PUBLICATIONS

Machine translation of Hamada JP 2006-113430, publication date: Apr. 27, 2006.*

Notice of Rejection mailed by Japan Patent Office on Sep. 1, 2015 in the corresponding Japanese patent application No. 2013-123244.

* cited by examiner

Fig. 5

| TestNo | CONFIGURATION OF STATIC ELIMINATOR | | RESULTS | | | |
|---|---|---|---|---|---|---|
| | DISCHARGE VOLTAGE | DISCHARGE ANGLE $\theta$ | TONER-SCATTERED IMAGE | INTERIOR CONTAMINATION | PAPER CHARGE | FIXING OFFSET |
| 1 | --- | --- | × | × × | +3.5kV | × |
| 2 | --- | --- | ○ | × | +1.7kV | △ |
| 3 | −2kV | 90° | × | × | +1.2kV | △ |
| 4 | −3kV | 90° | ○ | ▲ | +1.2kV | ○ |
| 5 | −4kV | 90° | ○ | ▲ | +0.5kV | ○ |
| 6 | −5kV | 90° | ○ | ▲ | +0.5kV | ○ |
| 7 | −2kV | 70° | × | × | +1.3kV | △ |
| 8 | −3kV | 70° | ○ | ▲ | +0.7kV | ○ |
| 9 | −4kV | 70° | ○ | ○▲ | +0.5kV | ○ |
| 10 | −2kV | 50° | × | × | +1.7kV | △ |
| 11 | −3kV | 50° | ○ | ○ | +0.7kV | ○ |
| 12 | −4kV | 50° | ○ | ○ | +0.6kV | ○ |
| 13 | −2kV | 30° | × | × | +1.6kV | △ |
| 14 | −3kV | 30° | ○ | ○ | +0.6kV | ○ |
| 15 | −4kV | 30° | ○ | ○ | +0.5kV | ○ |
| 16 | −2kV | 10° | × | × | +3.1kV | × |
| 17 | −3kV | 10° | × | × | +2.6kV | × |
| 18 | −4kV | 10° | × | × | +2.8kV | × |

IMAGE FORMING APPARATUS

INCORPORATION BY REFERENCE

This application claims priority to Japanese Patent Application No. 2013-123244 filed on Jun. 11, 2013, the entire contents of which are incorporated by reference herein.

BACKGROUND

The present disclosure relates to image forming apparatuses and particularly relates to a technique for improving image quality and preventing toner scattering in an image forming apparatus employing a belt transfer system in which a toner image on the surface of a photosensitive drum is transferred by a belt type transfer section.

Electrophotographic image forming apparatuses, such as a multifunction peripheral, a printer, a copier, and a facsimile device, include those employing a belt transfer system in which a toner image on the surface of a photosensitive drum (image carrier) is transferred by a belt type transfer section. The image forming apparatus with the belt transfer system is configured to induce electric charges on the surface of a transfer belt to electrostatically attract a recording paper sheet to the transfer belt, convey it in this state, and allow a toner image formed on the surface of a photosensitive drum to be transferred to the recording paper sheet in a nip between the transfer belt and the photosensitive drum.

This belt transfer system is excellent in terms of separability of the recording paper sheet from the photosensitive drum, stability of sheet conveyance, and image transferability but may cause separation discharge when the recording paper sheet after the transfer of the toner image thereto separates from the transfer belt. The separation discharge may scatter toner on the surface of the recording paper sheet, which results in a problem of the occurrence of an image defect (electrostatically toner-scattered image) and a problem in that scattered toner is accumulated in the apparatus to contaminate the apparatus interior. Furthermore, the recording paper sheet is strongly charged to the same polarity as the toner, which presents a problem of the occurrence of electrostatic offset in the fixing process.

As a solution to the above problems, a technique (Technique A) is known in which the image-forming surface of the recording paper sheet is exposed to an AC discharge at a position just short of where the recording paper sheet separates from the transfer belt, thus eliminating static electricity from the sheet to prevent separation discharge during separation of the sheet from the belt and the AC bias value is controlled to reduce the contamination of an AC discharger. As another solution, a technique (Technique B) is known in which a high-resistance, sheet-shaped transfer exit guide plate is provided downstream of the transfer belt in the direction of conveyance of the recording paper sheet to eliminate the static electricity of the sheet separated from the transfer belt using the guide plate and thus prevent separation discharge of the sheet.

SUMMARY

A technique improved over the above techniques is proposed as one aspect of the present disclosure.

An image forming apparatus according to the one aspect of the present disclosure includes an image carrier, a transfer belt, a fixing section, and a static eliminator.

The image carrier has a surface on which a toner image is to be formed.

The transfer belt is provided facing the surface of the image carrier, forms a nip serving as a transfer position with the image carrier, and is configured to transfer the toner image formed on the surface of the image carrier to a recording paper sheet with a transfer bias of opposite polarity to the surface of the image carrier.

The fixing section is configured to apply heat to the recording paper sheet having the toner image transferred thereto by the transfer belt and thus fix the toner image on the recording paper sheet.

The static eliminator is disposed downstream of the transfer position in a direction of conveyance of the recording paper sheet being conveyed by the transfer belt and is configured to expose a back surface of the recording paper sheet opposite to the surface having the toner image transferred thereto to a DC discharge having the same polarity as the transfer bias of the transfer belt and directed toward a position where the recording paper sheet separates from the transfer belt.

BRIEF DESCRIPTION OF THE DRAWINGS

FIG. 5 is a table showing results obtained by varying the discharge voltage and the orientation of discharge of the static eliminator.

DETAILED DESCRIPTION

Figure 1:
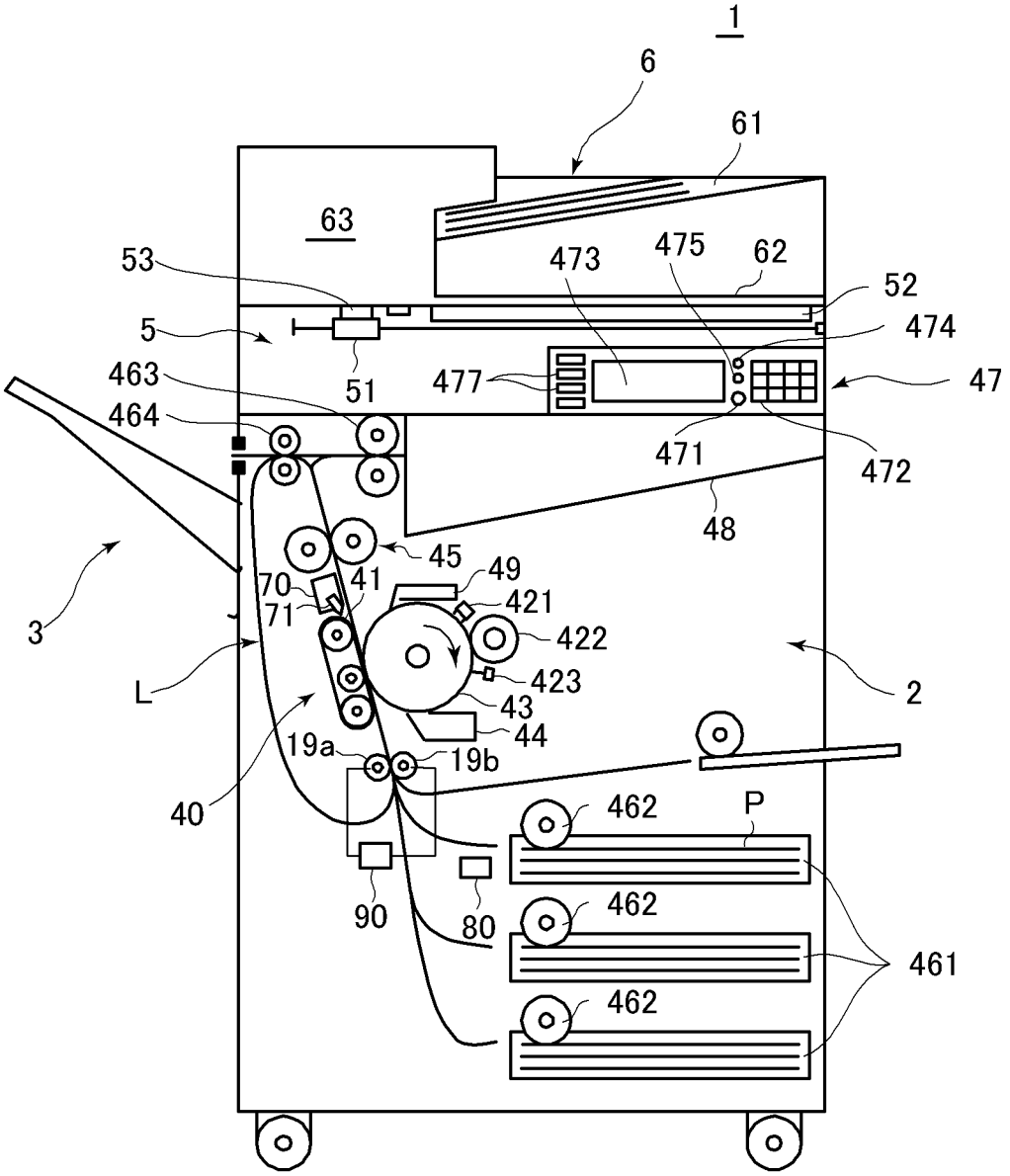
FIG. 1 is a front cross-sectional view showing the structure of an image forming apparatus according to one embodiment of the present disclosure.

Hereinafter, a description will be given of an image forming apparatus according to one embodiment of the present disclosure with reference to the drawings. FIG. 1 is a front cross-sectional view showing the structure of an image forming apparatus 1 according to one embodiment of the present disclosure.

The image forming apparatus 1 is a multifunction peripheral having multiple functions including, for example, a copy function, a print function, a scan function, and a facsimile function. The image forming apparatus 1 includes a main section 2, a stacking tray 3 disposed on the left of the main section 2, an image reading section 5 disposed on the top of the main section 2, and a document feed section 6 disposed on the top of the image reading section 5. Furthermore, a front portion of the image forming apparatus 1 is provided with an operating section 47 and a display 473.

The image reading section 5 includes: a scanner section 51 composed of a CCD (charge coupled device) sensor, an exposure lamp, and so on; an original glass plate 52 made of a transparent material, such as glass; and a document read slit 53. The scanner section 51 is configured to scan an image of an original document and output image data acquired by the scanning to a control unit 10 (see FIG. 3) to be described hereinafter. The document feed section 6 is configured to feed original documents put on a document placement table 61 thereof one by one and convey the original document to a position facing the document read slit 53.

The main section 2 includes a plurality of paper feed cassettes 461, a plurality of paper feed rollers 462 configured to feed recording paper sheets P sheet by sheet from their respective associated paper feed cassettes 461 and convey the recording paper sheet P to an image forming section 40, and the image forming section 40 configured to form an image on each of the recording paper sheets P conveyed from the paper feed cassettes 461.

The image forming section 40 includes: a photosensitive drum 43; a cleaning unit 49 configured to remove residual toner on the photosensitive drum 43; a charging roller (charging section) 422 configured to charge the surface of the photosensitive drum 43; an exposure section 423 configured to, based on image data acquired by the scanner section 51, output laser light to expose the surface of the photosensitive drum 43 to the laser light and thus form an electrostatic latent image on the surface of the photosensitive drum 43; a development section 44 configured to form a toner image on the photosensitive drum 43 based on the electrostatic latent image; a transfer belt 41 configured to nip a recording paper sheet P with the photosensitive drum 43 and transfer the toner image carried on the photosensitive drum 43 to the recording paper sheet P; a fixing section 45 configured to apply heat to the recording paper sheet P having the toner image transferred thereto to fix the toner image on the recording paper sheet P; and conveyance rollers 463, 464 provided in a paper conveyance path in the image forming section 40 and configured to convey the recording paper sheet P to the stacking tray 3 or a paper output tray 48.

A post-transfer guide 70 is a member disposed downstream of the transfer belt 41 in the direction of conveyance of the recording paper sheet and configured to support the recording paper sheet P, which is separating from the transfer belt 41 at a conveyance end position of the transfer belt 41, from the back surface of the recording paper sheet P opposite to the surface having the toner image transferred thereto and guide it to the fixing section 45. The post-transfer guide 70 is provided with a static eliminator 71 configured to eliminate static electricity from the recording paper sheet P separating from the transfer belt 41.

A hygrothermal sensor (temperature and humidity detecting section) 80 is configured to measure the temperature and humidity in the interior of the image forming apparatus 1. The hygrothermal sensor 80 includes: a thermometer formed such as of a thermistor; and a hygrometer. The hygrothermal sensor 80 is provided at a suitable location in the interior of the image forming apparatus 1, for example, near the paper feed cassettes 461.

A paper resistance sensor (paper resistance detecting section) 90 is configured to measure the electrical resistance of the recording paper sheet P. Specifically, the paper resistance sensor 90 measures the electrical resistance of the recording paper sheet P by applying a DC voltage to a roller pair composed of a pair of conveyance rollers 19*a*, 19*b* and measuring the current flowing across the recording paper sheet P nipped between the conveyance rollers 19*a*, 19*b* with an unshown ammeter.

Figure 2:
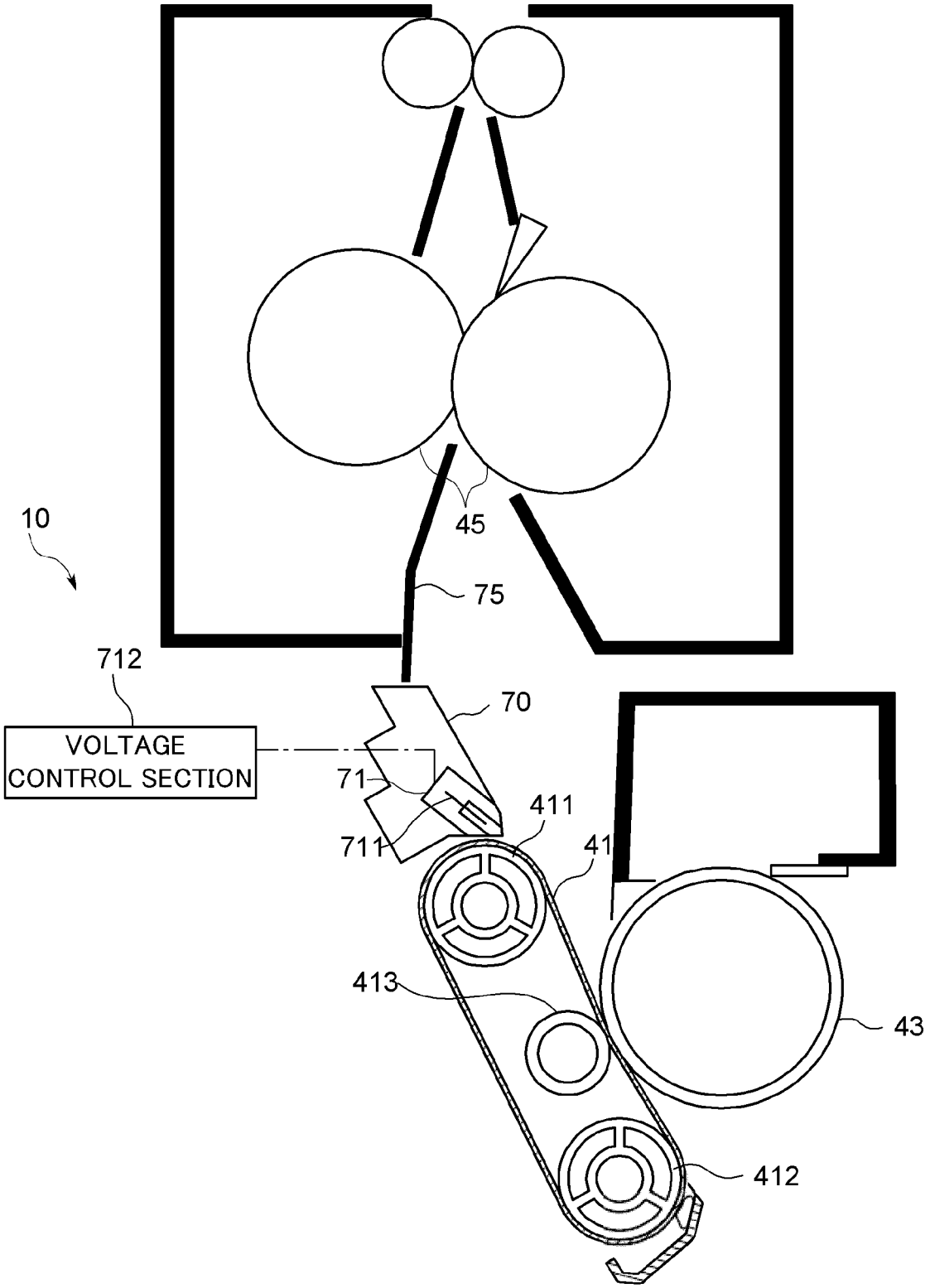
FIG. 2 is a detailed front cross-sectional view of a portion from a transfer belt to a fixing section in FIG. 1.

FIG. 2 is a detailed front cross-sectional view of a portion from the transfer belt 41 to the fixing section 45 in FIG. 1. The post-transfer guide 70 is disposed downstream of the transfer belt 41 in the direction of conveyance of the recording paper sheet and a pro-fixing guide 75 is disposed downstream of the post-transfer guide 70. The recording paper sheet P having separated from the transfer belt 41 is guided to the post-transfer guide 70 and the pro-fixing guide 75 and then conveyed to the fixing section 45.

The transfer belt 41 is a belt mounted around a drive roller 411 and a driven roller 412 and capable of endlessly running between them. A transfer roller 413 is pressed toward the surface of the photosensitive drum 43 with the transfer belt 41 in between.

The transfer roller 413 is connected to an unshown high-voltage power supply section. When the high-voltage power supply section applies a transfer bias voltage to the transfer roller 413, a toner image formed on the surface of the photosensitive drum 43 is transferred to the recording paper sheet P at the nip between the photosensitive drum 43 and the transfer roller 413.

The above transfer bias voltage from the high-voltage power supply section is also applied to the transfer belt 41 through the transfer roller 413, so that the recording paper sheet P is electrostatically attracted to the transfer belt 41. Specifically, the transfer belt 41 is charged to an opposite polarity to the surface of the photosensitive drum 43 to electrostatically attract the recording paper sheet P and conveys the recording paper sheet P while pressing it against the photosensitive drum 43, thereby transferring the toner image formed on the surface of the photosensitive drum 43 to the recording paper sheet P.

The recording paper sheet P electrostatically attracted onto the transfer belt 41 is separated from the transfer belt 41 at the conveyance end position of the transfer belt 41 by the curvature of the drive roller 411. Therefore, a position near where the transfer belt 41 and the drive roller 411 starts to make contact with each other is the position where the recording paper sheet P comes unstuck (separates) from the transfer belt 41 (a separating position).

The static eliminator 71 disposed in the post-transfer guide 70 is configured to expose the recording paper sheet P to a DC discharge of the same polarity as the charge polarity of the transfer belt 41 to eliminate static electric charge from the recording paper sheet P. The static eliminator 71 includes a plurality of discharge needles 711 and a voltage control section 712.

The discharge needles 711 are capable of initiating a corona discharge from their distal ends to provide a DC discharge. The voltage control section 712 is configured to output the discharge voltage of the discharge needles 711 to control the voltage value.

The plurality of discharge needles 711 are arranged at several millimeter intervals in the width direction of the transfer belt 41 (that of the recording paper sheet P). The arrangement of the plurality of discharge needles 711 in this manner provides efficient static elimination of the recording paper sheet P.

Furthermore, the discharge needles 711 are provided so that their distal ends are oriented to the position where the recording paper sheet P separates from the transfer belt 41. Since the discharge needles 711 are disposed in the post-transfer guide 70, they are located downstream of a toner transfer position, which is the nip between the photosensitive drum 43 and the transfer belt 41, in the direction of conveyance of the recording paper sheet being conveyed by the transfer belt 41 and are located toward the back surface of the recording paper sheet P opposite to the surface having the toner image transferred thereto.

Therefore, the discharge needles 711 expose the back surface of the recording paper sheet P opposite to the surface having the toner image transferred thereto, under the control of the voltage control section 712 to change the discharge voltage, to a DC discharge having the same polarity as the transfer bias of the transfer belt 41 and directed toward the position where the recording paper sheet P separates from the transfer belt 41.

Figure 3:
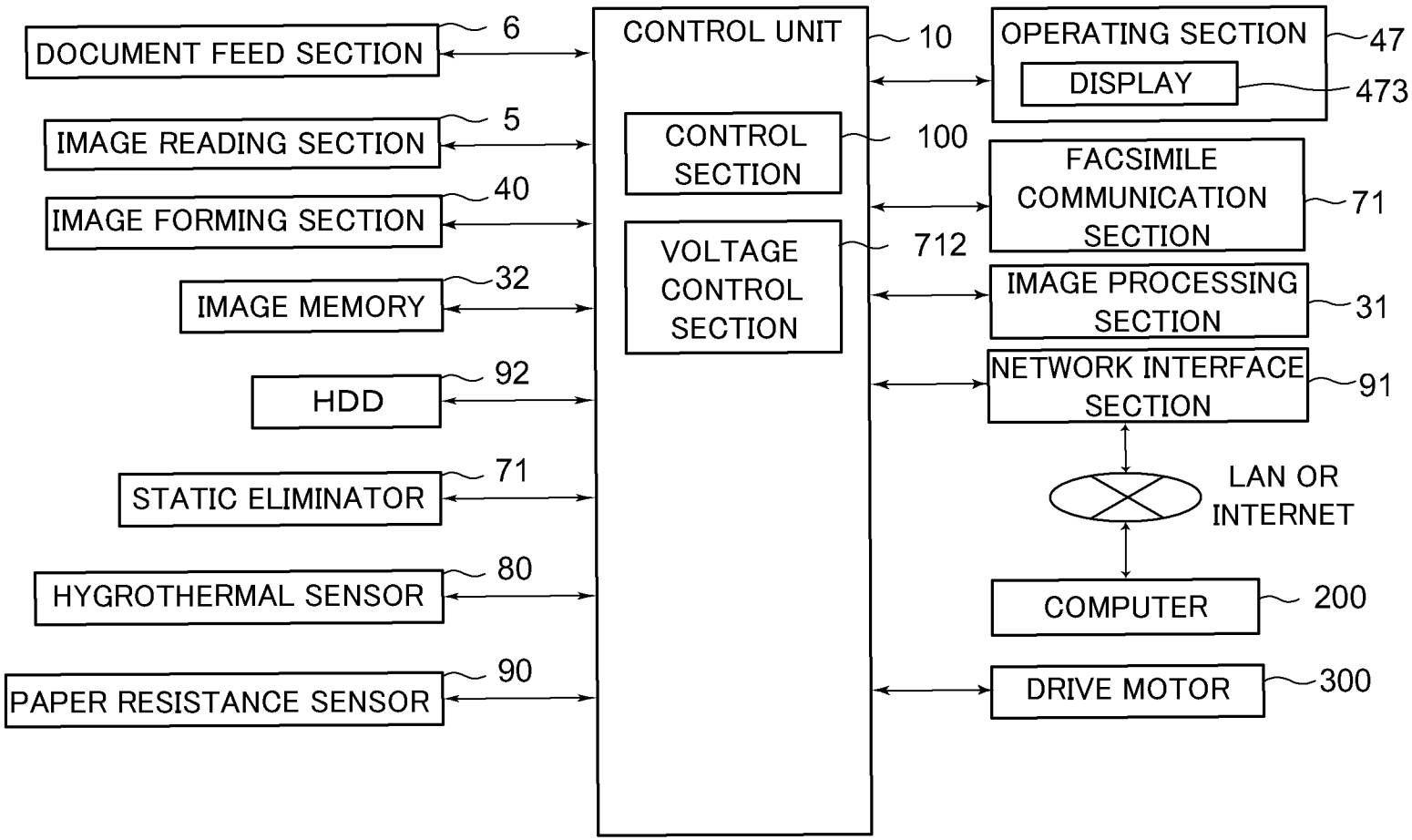
FIG. 3 is a functional block diagram schematically showing an essential internal architecture of the image forming apparatus.

Next, a description will be given of the structure of the image forming apparatus 1. FIG. 3 is a functional block diagram showing an essential internal architecture of the image forming apparatus 1.

The image forming apparatus 1 includes a control unit 10. The control unit 10 is composed of a CPU (central processing unit), a RAM, a ROM, a dedicated hardware circuit, and so on and governs the overall operation control of the image forming apparatus 1. For example, the RAM stores data on the paper type of the recording paper sheets contained in each paper feed cassette 461, (for example, quality paper, heavy paper, recycled paper or the back side of printed paper).

The image reading section 5 is under the control of the control unit 10 and includes the above scanner section 51 including the CCD sensor, the exposure lamp, and so on. The image reading section 5 is configured to read an image from an original document by applying light to the original document with the exposure lamp and receiving reflected light from the original document.

An image processing section 31, if necessary, processes image data of the image read by the image reading section 5. For example, in order that the image read by the image reading section 5 is improved in quality after the formation of an image in the image forming section 40, the image processing section 31 performs predetermined image processing, such as shading correction.

An image memory 32 provides a region for temporarily storing data of image of the original document read by the image reading section 5 and temporarily storing data to be printed by the image forming section 40.

The image forming section 40 is configured to form an image of print data read by the image reading section 5, an image of print data received from a network-connected computer 200, or the like.

The operating section 47 is configured to receive operator's commands for various types of operations and processing executable by the image forming apparatus 1. The operating section 47 includes a display 473.

A facsimile communication section 71 includes a coding/decoding section, a modulation/demodulation section, and an NCU (network control unit), all of which are not illustrated, and performs facsimile communication using a public telephone network.

A network interface section 91 is constituted by a communication module, such as a LAN board, and configured to transfer various data to and from computers 200 and the like in a local area via a LAN or the like connected to the network interface section 91.

An HDD 92 is a large storage device capable of storing document images and the like read by the image reading section 5.

A drive motor 300 is a drive source for applying a rotary drive force to various rotary members of the image forming section 40, such as the photosensitive drum 43, and various rotary members of the fixing section 45.

The control unit 10 includes the control section 100 and the voltage control section 712. The control section 100 is connected to the image reading section 5, the document feed section 6, the image processing section 31, the image memory 32, the image forming section 40, the operating section 47, the facsimile communication section 71, the network interface section 91, the HDD (hard disk drive) 92, the static eliminator 71, the hygrothermal sensor 80, the paper resistance sensor 90, and so on and controls the operations of these components.

The voltage control section 712 can change the discharge voltage of the static eliminator 71 according to detection results of the hygrothermal sensor 80. Specifically, the static eliminator 71 changes the discharge voltage according to the detection results of the hygrothermal sensor 80. Thus, the static eliminator 71 runs a DC discharge with a voltage suitable for the current temperature and humidity of the interior of the image forming apparatus 1, thus providing an improvement in the effect of eliminating static electricity from the recording paper sheet P.

Furthermore, the voltage control section 712 can change the discharge voltage of the static eliminator 71 according to detection results of the paper resistance sensor 90.

Specifically, the static eliminator 71 changes the discharge voltage according to the detection results of the paper resistance sensor 90. Thus, the static eliminator 71 runs a DC discharge with a voltage suitable for the actual electrical resistance of the recording paper sheet P, thus providing an improvement in the effect of eliminating static electricity from the recording paper sheet P.

Moreover, the voltage control section 712 can change the discharge voltage of the static eliminator 71 according to the paper type of the recording paper sheet P stored in the RAM. Specifically, the static eliminator 71 changes the discharge voltage according to the paper type of the recording paper sheet P. Thus, the static eliminator 71 runs a DC discharge with an optimal voltage for each paper type, thus providing an improvement in the effect of eliminating static electricity from the recording paper sheet P.

Instead of providing the voltage control section 712 separately from the control section 100, the control section 100 may function also as the voltage control section 712.

Next, a description will be given of verification results of the static elimination effect of the static eliminator 71. FIG. 5 is a table showing results obtained by varying the discharge voltage and the orientation of discharge of the static eliminator 71. In the table, Test No. 1 shows the results in the case where the static eliminator 71 was not provided. Test No. 2 shows the results in the case where, instead of the static eliminator 71, a high-resistance sheet member as in Technique B previously described was used.

In FIG. 5, "Discharge Voltage" indicates the discharge voltage of the static eliminator 71. Because the transfer belt 41 is charged to a negative voltage, the discharge voltage of the static eliminator 71 is a negative voltage of the same polarity as the transfer belt 41.

Figure 4:
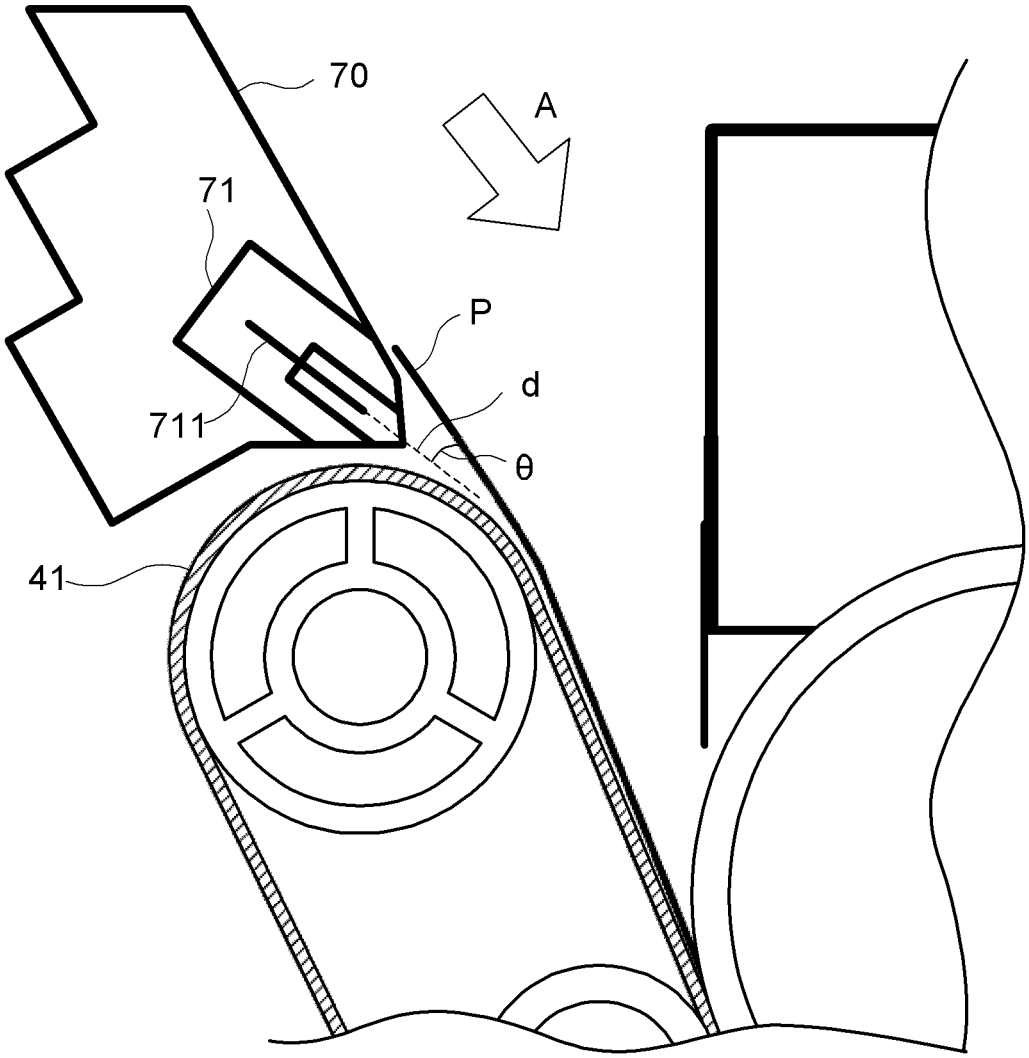
FIG. 4 is a view illustrating the orientation of discharge of a static eliminator.

"Discharge Angle θ" indicates the orientation of discharge of the static eliminator 71. FIG. 4 is a view illustrating the orientation of discharge of the static eliminator 71. As shown in FIG. 4, the discharge angle θ is an angle formed by the surface of the recording paper sheet P separated from the transfer belt 41 and the extended line d of the discharge needles 711.

"Toner-Scattered Image" refers to an image defect produced by scattering of toner on the surface of the recording paper sheet due to separation discharge when the recording paper sheet separates from the transfer belt 41. The toner-scattered image is a phenomenon, also referred to as a scale-like image, that the toner concentration becomes locally denser, wherein, microscopically, toner dots are scattered all around the surface of the recording paper sheet. The cross sign indicates that a toner-scattered image was found, while the open circle sign indicates that no toner-scattered image was found.

"Interior Contamination" refers to the contamination of the apparatus interior by scattered toner. Herein, evaluation was made of how much a metal sheet opposed to the position where the recording paper sheet P separated from the belt was contaminated. The combination of two cross signs indicates heavy contamination, the single cross sign indicates much contamination (a large degree of contamination), the filled triangle sign indicates relatively large contamination (a medium degree of contamination), the combination of the open circle sign and the filled triangle sign indicates small contamination (a small degree of contamination), and the open circle sign indicates very little contamination (substantial freedom from contamination).

"Paper Charge" refers to the charge voltage of the recording paper sheet having entered the fixing section 45 after the static elimination process. As the paper charge decreases, the static eliminator 71 offers a higher static elimination effect.

"Fixing Offset" refers to electrostatic offset occurring in the fixing process. The cross sign indicates a large degree of electrostatic offset, the open triangle sign indicates a medium degree of electrostatic offset, and the open circle sign indicates a small degree of electrostatic offset.

As shown in FIG. 5, in the cases where the orientation of the discharge needles 711 was approximately perpendicular to the surface of the recording paper sheet (Test Nos. 3 to 6), the discharge needles 711 ran a DC discharge toward the recording paper sheet, so that the static electricity of the recording paper sheet could be sufficiently removed to eliminate fixing offset. However, separation discharge could not be sufficiently prevented, failing to eliminate the contamination of the apparatus interior. For example, in Test No. 2, the apparatus interior was heavily contaminated. In Test No. 5, the apparatus interior is contaminated relatively largely but less than in Test No. 2. On the other hand, when the orientation of the discharge needles 711 was near parallel to the surface of the recording paper sheet (Test Nos. 16 to 18), the discharge needles 711 were oriented neither to the recording paper sheet nor the separating position, so that not only separation discharge could not be prevented but also the static electricity of the recording paper sheet could not be eliminated. Therefore, the results in these cases were the same as in the case where the static eliminator 71 was not provided.

In view of the above, the cases where separation discharge could be prevented and the static electricity of the recording paper sheet could be sufficiently eliminated are: (1) the case where the discharge angle was 70 degrees and the discharge voltage was −4 kV (Test No. 9); (2) the case where the discharge angle was 50 degrees and the discharge voltage was −3 kV (Test No. 11); (3) the case where the discharge angle was 50 degrees and the discharge voltage was −4 kV (Test No. 12); (4) the case where the discharge angle was 30 degrees and the discharge voltage was −3 kV (Test No. 14); and (5) the case where the discharge angle was 30 degrees and the discharge voltage was −4 kV (Test No. 15). For example, FIG. 5 shows that Test No. 9 provided less contamination than Test Nos. 2 and 5.

It can be seen from the above verification results that by providing the static eliminator 71 of this embodiment configured to expose the back surface of the recording paper sheet to a DC discharge and running a DC discharge with an appropriate DC voltage in an appropriate orientation, all of toner scattering in the apparatus interior, fixing offset, and toner-scattered image can be prevented.

More specifically, by disposing a discharger 71 so that the discharge needles 711 are oriented to the separating position and applying an appropriate voltage to the discharge needles 711, all of toner scattering in the apparatus interior, fixing offset, and toner-scattered image can be eliminated.

Furthermore, from the results of Test Nos. 11, 12, 14, and 15, it can be seen that when the discharge needles 711 are disposed so that the discharge angle θ, which is an angle formed by the recording paper sheet P separated from the transfer belt 41 and the extended line d of the discharge needles 711, is between 30° and 50°, both inclusive, and the discharge voltage of the discharge needles 711 is between 3 kV and 4 kV, both inclusive, with the same polarity as the transfer bias, this is preferred because separation discharge can be further prevented and the static electricity of the recording paper sheet can be more sufficiently eliminated.

In the aforementioned, generally known Technique A, ozone may be produced when running an AC discharge for the purpose of eliminating static electricity from the recording paper sheet and the effective voltage is as high as 6 kV or more. In addition, since the image-forming surface of the recording paper sheet is exposed to the discharge, the contamination of the discharger by toner cannot be sufficiently prevented.

In the aforementioned Technique B, although the high-resistance sheet member is effective as an inexpensive static eliminator and the occurrence of an image defect (electrostatically toner-scattered image) due to separation discharge upon separation of the recording paper sheet from the transfer belt can be reduced, the electric charge of the recording paper sheet cannot be sufficiently eliminated when the recording paper sheet has high resistance (for example, during use at low humidities or with the use of the back surface of the printed recording paper sheet), resulting in the occurrence of electrostatic offset in the fixing process.

Unlike the above known techniques, in the image forming apparatus according to the one embodiment of the present disclosure, the image forming apparatus with the belt transfer system can sufficiently prevent the separation discharge of the recording paper sheet P and sufficiently eliminate the electric charge of the recording paper sheet P. Thus, the occurrence of an image defect, the contamination of the apparatus interior, and fixing offset can be prevented. In addition, since the contamination of the apparatus interior can be prevented, the image forming apparatus can be used for a long period without the need for cleaning and maintenance.

The present disclosure is not limited to the above embodiment and can be modified in various ways. For example, although the description of the above embodiment is given taking a multifunction peripheral as an example of the image forming apparatus according to the present disclosure, the example is merely illustrative and the image forming apparatus may be any other electronic apparatus, for example, any other image forming apparatus, such as a printer, a copier or a facsimile machine.

The structure and processing shown in the above embodiment with reference to FIGS. 1 to 5 are merely illustrative of the present disclosure and not intended to limit the present disclosure to the above particular structure and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a conveyance roller that conveys a recording paper sheet;

an image carrier having a surface on which a toner image is to be formed;

a transfer belt provided facing the surface of the image carrier and subjected to a transfer bias of an opposite polarity to the surface of the image carrier, the transfer belt being configured to: (1) electrostatically adsorb the recording paper sheet conveyed by the conveyance roller to a surface of the transfer belt with the transfer bias, and convey the recording paper sheet maintaining the recording paper sheet electrostatically adsorbed to the surface of the transfer belt; (2) transfer the toner image formed on the surface of the image carrier to the recording paper sheet at a nip position between the image carrier by pressing the recording paper sheet against the image carrier during the conveyance of the recording paper sheet; and (3) convey the recording paper sheet to which the toner image has been transferred to a downstream side of the transfer belt in a conveyance direction of the recording paper sheet;

a fixing section configured to apply heat to the recording paper sheet having the toner image transferred thereto by the transfer belt and thus fix the toner image on the recording paper sheet;

a post-transfer guide located in a position away from the nip position with the transfer belt in between and being near the transfer belt downstream of the transfer belt in the conveyance direction of the recording paper sheet, the post-transfer guide having a guide surface which supports, from a back surface of a surface having the toner image transferred thereto, the recording paper sheet separating from the transfer belt at a downstream end of the direction of conveyance of the recording paper sheet and conveyed by the transfer belt, and configured to guide the recording paper sheet to the fixing section; and a static eliminator having discharge needles and a voltage control section controlling a discharge voltage applied to the discharge needles, provided in an interior of the post-transfer guide so that the discharge needles are located on further behind of the back surface of the recording paper sheet opposite to the surface having the toner image transferred thereto than the guide surface of the post-transfer guide, the discharge needles being disposed downstream of the transfer position in the direction of conveyance of the recording paper sheet being conveyed by the transfer belt and the back surface of the recording paper sheet opposite to the surface having the toner image transferred thereto in a manner such that distal ends thereof are oriented to a position where the recording paper sheet separates from the downstream end of the transfer belt, the static eliminator being configured to eliminate static electricity from the recording paper sheet separating from the transfer belt, by a DC discharge based on the discharge voltage through a corona discharge having the same polarity as the transfer bias of the transfer belt from the distal ends of the discharge needles, the back surface of the recording paper sheet opposite to the surface having the toner image transferred thereto being exposed to the DC discharge, wherein the voltage control section sets the discharge voltage of the discharge needles at a value between 3 kV and 4 kV, both inclusive, with the same polarity as the transfer bias, and the discharge needles are disposed so that a discharge angle formed by the recording paper sheet separated from the transfer belt and an extended line of the discharge needles is between 30° and 50°, both inclusive.

2. The image forming apparatus according to claim 1, further comprising a temperature and humidity detecting section configured to detect temperature and humidity in an interior of the image forming apparatus, wherein the voltage control section is configured to control the discharge voltage of the static eliminator according to detection results of the temperature and humidity detecting section.

3. The image forming apparatus according to claim 1, further comprising a paper resistance detecting section configured to detect an electrical resistance of the recording paper sheet, wherein the voltage control section is configured to control the discharge voltage of the static eliminator according to detection results of the paper resistance sensor.

4. The image forming apparatus according to claim 1, further comprising a storage section storing a paper type of the recording paper sheet to be conveyed, wherein the voltage control section is configured to control the discharge voltage of the static eliminator according to the paper type of the recording paper sheet stored in the storage section.

* * * * *